US006383095B1

(12) United States Patent
Azotea

(10) Patent No.: US 6,383,095 B1
(45) Date of Patent: May 7, 2002

(54) GOLF-BALL INDICATOR

(76) Inventor: Paul A. Azotea, 1271 Black Birch Ct., Toms River, NJ (US) 08753

( * ) Notice: Subject to any disclaimer, the term of this patent is extended or adjusted under 35 U.S.C. 154(b) by 57 days.

(21) Appl. No.: 09/633,678

(22) Filed: Aug. 7, 2000

(51) Int. Cl.[7] ..... A63B 57/00
(52) U.S. Cl. ..... 473/406; 473/405; 473/408
(58) Field of Search ..... 473/406, 405, 473/407, 409, 131, 169, 185; D21/793, 794; 116/173; 52/103

(56) References Cited

U.S. PATENT DOCUMENTS 3,216,728 A * 11/1965 Whitney
4,129,237 A * 12/1978 Grinder
4,161,723 A * 7/1979 De Vittori
D266,832 S * 11/1982 Brown
D270,747 S * 9/1983 Eisinger et al.
4,407,505 A * 10/1983 Kendziorski
4,649,678 A * 3/1987 Lamson
4,905,624 A * 3/1990 Krolzick
4,960,239 A * 10/1990 Wait
5,026,061 A * 6/1991 Davis
5,054,777 A * 10/1991 Borden et al.
5,143,371 A * 9/1992 Strahan
5,211,395 A * 5/1993 Liao
5,247,900 A * 9/1993 Sobczak
5,433,436 A * 7/1995 Hoyt et al.
5,441,267 A * 8/1995 Alder
5,485,700 A * 1/1996 Van Vranken
6,095,934 A * 8/2000 Ohama
6,220,973 B1 * 4/2001 Hsu

* cited by examiner

*Primary Examiner*—Paul T. Sewell
*Assistant Examiner*—Nini F. Legesse
(74) *Attorney, Agent, or Firm*—Charles I. Brodsky

(57) ABSTRACT

A golf ball indicator in the nature of a stake which is pressed into the ground to mark a golf ball that would otherwise be hidden by the tall grass of a golf course "rough", having a visible flag and of a length to extend above the height of the grass when inserted by pressing down on a surrounding flange positioned adjacent a bottom spike of the stake or in serving as a depth stop for the placement.

8 Claims, 1 Drawing Sheet

GOLF-BALL INDICATOR

FIELD OF THE INVENTION

This invention relates to golfing equipment and, more particularly, to a golfing accessory which makes locating one's ball, and play from the rough, both more convenient and less costly making the game more enjoyable for golfers of all levels of skill.

BACKGROUND OF THE INVENTION

As is well known, there presently exists an increased interest in the game of golf. This, along with the acknowledged high ratio of golfers to golf courses, has placed a high demand and burden on the course operator. Specifically, in order for the golf course to handle the increased number of players, it has increased the number of tee times over the day (thereby shortening the duration between tee times), causing groups to tee off one after the other. Because of the increased traffic on the golf course, and the group approaching right behind, golfers are often forced to abandon a golf-ball that, although within bounds, is not clearly visible to the golfer—which would otherwise take an inordinate amount of time in trying to locate it. As a result golfers often suffer not only the expense of having to replace the golf ball (which may cost up to several dollars each) but additionally suffer the frustration of having to add strokes to their score for a lost ball, often disrupting their concentration and rhythm of play.

This problem exists even when playing with a group of other golfers who spot where the ball landed, and try to indicate its position as best they can. Often, by the time the golfer walks the hundred or so yards towards the ball, he/she has lost all bearings and/or landmarks which the other golfers referred to back on the tee, or from wherever the ball was struck. In other instances, one of the golfers in the party may have been kind enough to leave an article of clothing or piece of equipment near the ball when passing by it on the way to his/her own ball. Unfortunately, this can lead to a few undesirable occurrences: a) the ground is wet and/or dirty and thereby causes the article or equipment left to become wet and/or dirty also; b) the article or equipment is inadvertently left behind and the golfer who left it is forced to return to look for it when, and if, they realize that it has been forgotten; and c) the article or equipment left behind is totally forgotten, or never found, thereby requiring a replacement cost which can be quite expensive if a club were left as a marker, for example. All of these occurrences cause undue expense and aggravation to the player who left the article or equipment behind, as well as slowing down play when everyone goes back to try and locate it.

OBJECTS OF THE INVENTION

It is an object of the present invention, therefore, to provide a new, inexpensive, lightweight, decorative, method of marking the location of a golf-ball—and particularly one that has strayed off the fairway and into the rough—so that it can be located easily by an advancing player.

It is another object of the present invention to substantially reduce the amount of time spent by golfers searching for their ball, or having to return for forgotten equipment, thereby speeding up play and easing congestion on the golf course.

SUMMARY OF THE INVENTION

As will become clear hereinafter, the present invention provides a golf-ball indicator to attend to this, and in a manner so as to limit the misplacement and/or soiling of articles or equipment left as indicators—thereby saving time, energy, and money to the playing golfer. AS will also become clear, such an indicator also provides an inexpensive method for companies to advertise their products or services on the golf course. AS will additionally be seen, an indicator of this type may be made readily available to the golfer by packaging it with a customized golf accessory organizer which clips to the side of a golf bag or cart.

Thus, and as described below, the golf-ball indicator of the invention is in the nature of a decoratively attractive, inexpensively priced stake, designed to project above the height of the typical "rough" surrounding a golf course fairway. As will also be seen, the stake is generally constructed in the form of a flag affixed to the upper terminus of a shaft whose lower terminus is pointed so as to penetrate the ground easily. In a preferred embodiment, the shaft is of sufficient strength not to bend or fold when being pressed into the ground via an integrated flange located above the point. Such flange, additionally acts as a depth stop, to avoid pressing the shaft too deeply into the ground. In such embodiment of the invention the entire indicator can be made from a single plastic mold, thereby having no moving parts to fall off or wear with use.

BRIEF DESCRIPTION OF THE DRAWING

These and other features of the invention will be more clearly understood from a consideration of the following description, taken in connection with the accompanying drawing, in which.

DETAILED DESCRIPTION OF THE DRAWING

Figure 1:
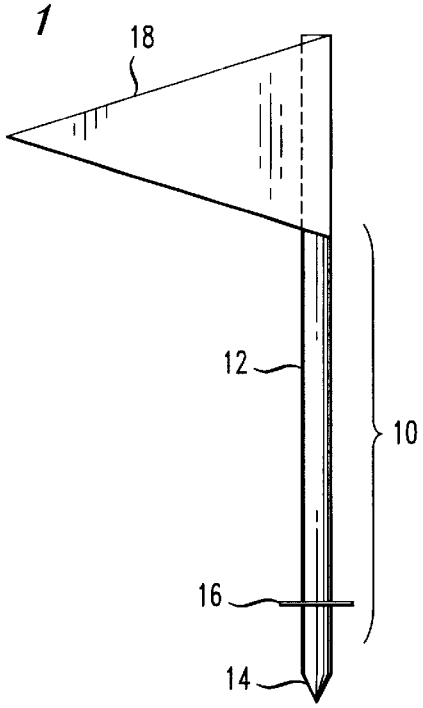
FIG. 1 is a side perspective view of a golf-ball indicator embodying the principles of the present invention.
Figure 2:
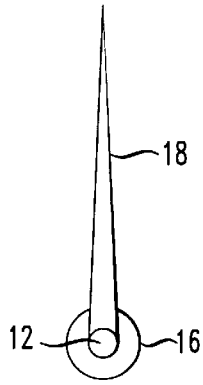
FIG. 2 is top view of the indicator, helpful in an understanding of the invention.

In the drawing, the golf ball indicator of the invention is generally in the form of a stake 10, having a shaft 12 with a pointed terminus 14, an insertion flange/depth stop 16, and a flag 18. Whether manufactured of plastic—as in a preferred embodiment—or of some other material, the stake 10 is rigid enough to withstand being pushed into dry soil or turf repeatedly, and may be carried in a rear pants pocket, or thrown in a golf bag. The shaft 12 is particularly composed of a water resistant, non-corrosive material to be unaffected when pressed into a wet ground. The shaft 12, may be of the order of one-quarter (¼) inch in diameter, although the diameter may vary with the material used, as the diameter is defined by the rigidity required by the shaft 12. The lower terminus of the shaft is formed to a point 14, to more easily facilitate insertion of the stake 10, into the ground but is not so sharp as to injure the user if struck, or puncture his/her pant pocket if carried there.

Approximately one (1) inch above the point 14, along the shaft 12, a flange 16 is provided to facilitate the insertion of the stake 10 into the ground without placing such force on the top of the shaft 12 which might cause the shaft 12 to flex, weaken or break. The flange 16 is integrated into the shaft 12, and extends outwardly therefrom with a diameter large enough for the user to place a thumb and forefinger on its lip in pressing the stake 10 into the ground. As will be appreciated, the larger diameter flange 16 thus engages the ground as a depth-stop, giving the shaft 12 increased lateral support.

As shown in FIG. 1, towards the top, blunt end of the shaft 12 is a flag 18, of a size and color to be readily visible to a golfer from a distance of 200 yards. Such flag 18 can be either integrated onto the shaft 12, or removeably affixed with the stake 12 about its top in a manner so as not to slide towards the bottom of the shaft, or to rotate about the axis of the shaft. The shaft 12 may be of a minimum length of four (4) inches between the flange 16 and the bottom of the flag 18 to permit a display of the flag above the typical height of the rough, making the flag visible even in un-manicured areas of the golf course—besides the fairway, itself. In this respect, the shaft 12 may be of the order of six and one half (6½) inches long.

In a preferred embodiment of the invention, the shaft 12, the point 14, the flange 16, and the flag 18 may all be one piece, manufactured by injecting plastic into a single mold, thereby permitting assembly line manufacturers to produce the indicator in large quantities, at a low cost, and requiring little manual labor. The rigid flag 18 could be manufactured flat, to pass through a printing press or like machine to apply decals, corporate logos or other identifying decorative marks as any desired advertising material.

Figure 3:
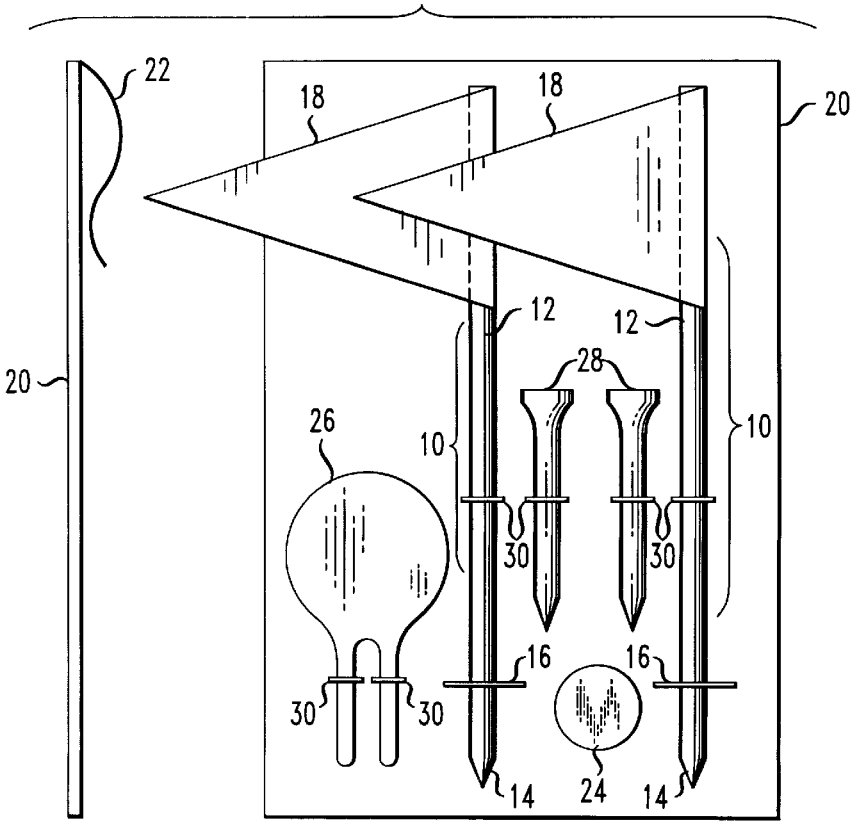
FIG. 3 is a top view of a golf accessory organizer in which the golf-ball indicator may be packaged for sale.

In use of the invention, when a time arises for a player to mark where a golf ball has landed, before proceeding to his/her own ball, the player may simply detach the indicator 10 from the golf accessory organizer he/she typically carries, as attached, by way of illustration, to the side of their own golf bag or cart. Shown in FIG. 3, the organizer 20 (with its attachment clip 22) may be designed to hold a few indicators 10, a ball marker 24, for use on the putting green, a divot fixing tool 26, and several tees 28—each of which is removeably secured with its face by a plurality of retention clips 30. That player then proceeds to press the indicator 10 into the ground next to the golf ball via the insertion flange 16 until the flange strikes the ground, causing the flag 18 to stand erect above the rough. The player can then proceed on to his/her own ball without having to wait for the owner of the ball to approach, in order to point out the balls location. The indicator 10 is then pulled from the ground by the playing partner, who hits the next shot and who eventually returns the indicator 10 when all the group meet up at the green.

While there have been described what are considered to be preferred embodiments of the present invention, it will be readily appreciated by those skilled in the art that modifications can be made without departing from the scope of the teachings herein. Thus, whereas, a plastic composition has been described for use as the indicator of the invention, it will be appreciated that any material can be employed—dependent upon its strength—and that any combination of individual pieces can be employed together, instead of the single fabrication set out above. For at least such reasons, therefore, resort should be had to the claims appended hereto for a true understanding of the scope of the invention.

I claim:

1. A golf accessory organizer comprising:

a face surface;

individual ones of a class of golf ball location indicators, putting green ball markers, and divot fixing tools;

a plurality of retention clips removably securing individual ones of said location indicators, ball markers, and fixing tools to said face surface;

and a clip attaching said face surface to a side of a user's golf bag or cart;

and wherein each of said golf ball location indicators include a shaft having a pointed bottom end and a blunt top end;

an insertion flange/depth stop fixedly positioned adjacent to, but above said pointed bottom end of said shaft;

and a flag fixedly positioned adjacent to, but below said blunt end of said shaft.

2. The golf accessory organizer indicator of claim 1 wherein said shaft of each golf ball location indicator is composed of a water resistant non-corrosive, rigid material.

3. The golf accessory organizer of claim 2 wherein said shaft of each golf ball location indicator is of a length to extend said flag above the height of a golf course rough when said pointed bottom end is inserted therein.

4. The golf accessory organizer of claim 3 wherein said shaft of each golf ball location indicator is of a diameter to resist bending when said pointed bottom end is inserted into a golf course rough.

5. The golf accessory organizer of claim 4 wherein said shaft of each golf ball location indicator is of the order of 6½ inches in length and ¼ inch in diameter.

6. The golf accessory organizer of claim 4 wherein said insertion flange/depth stop of each golf ball location indicator is fixedly positioned some 1 inch above said pointed bottom end of said shaft.

7. The golf accessory organizer of claim 6 wherein said insertion flange/depth stop of each golf ball location indicator is also composed of a water resistant, non-corrosive, rigid material.

8. The golf accessory organizer of claim 7 wherein said flag of each golf ball location indicator is additionally composed of a water resistant, non-corrosive, rigid material.

* * * * *